United States Patent [19]

Quakenbush

[11] 4,001,901

[45] Jan. 11, 1977

[54] CONVERTIBLE SEAT-BED

[75] Inventor: Howard M. Quakenbush, Apple River, Ill.

[73] Assignee: Flexsteel Industries, Inc., Dubuque, Iowa

[22] Filed: Aug. 6, 1975

[21] Appl. No.: 602,203

Related U.S. Application Data

[63] Continuation-in-part of Ser. No. 402,860, Oct. 2, 1973, Pat. No. 3,913,152.

[52] U.S. Cl. ..... 5/37 R; 5/18 R; 297/318; 297/342

[51] Int. Cl.[2] ..... A47C 17/17

[58] Field of Search ..... 297/63, 65, 67, 83–87, 297/245, 316–318, 322, 341–343, 354; 5/17, 18 R, 37 R, 47, 48

[56] References Cited

UNITED STATES PATENTS

| | | | |
|---|---|---|---|
| 2,504,645 | 4/1950 | Burnett | 297/67 |
| 2,544,980 | 3/1951 | Brown | 297/67 |
| 2,627,613 | 2/1953 | Lund | 5/47 |
| 3,171,684 | 3/1965 | Carte | 5/48 X |
| 3,634,893 | 1/1972 | Hern et al. | 5/37 R |
| 3,844,608 | 10/1974 | Freedman | 5/47 X |

FOREIGN PATENTS OR APPLICATIONS

| | | | |
|---|---|---|---|
| 474,696 | 6/1951 | Canada | 5/37 R |
| 73,630 | 9/1960 | France | 5/37 R |

*Primary Examiner*—Roy D. Frazier
*Assistant Examiner*—William E. Lyddane
*Attorney, Agent, or Firm*—Brezina & Lund

[57] ABSTRACT

A seat-bed assembly is provided including a pair of units in facing relation each including a seat and a back, the units being operable between a seat condition in which forward edge portions of the seats are spaced a substantial distance from each other with the backs projecting upwardly and rearwardly from rearward edge portions of the seat and a bed condition in which the seat sections are moved forwardly to position the forward edges thereof in contiguous relation and in which the backs are moved down behind the seats, the upper surfaces of the seats and backs being then in a common horizontal plane. An important feature is in the provision of an operating mechanism for each unit including pivotal arms pivotally connected to the back, first links pivotally connected between intermediate points of the arms and the rearward part of the seat and second links pivotally connected between intermediate points of the first links and the back. The distance between the axes of pivotal connections are such that the top edge portion of the back is moved in a substantially vertical path when the seat is moved between its rearward and forward seat and bed positions.

12 Claims, 6 Drawing Figures

FIG 3
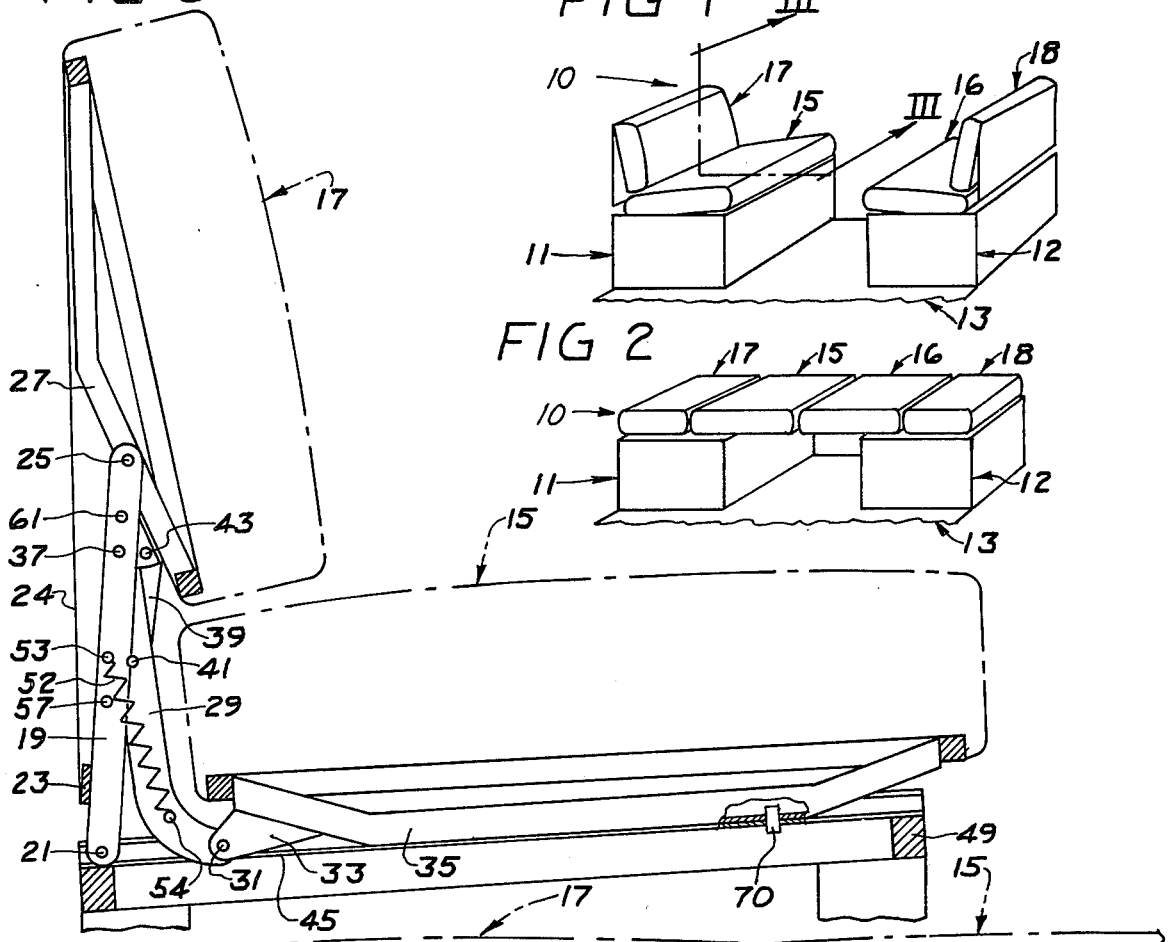
FIG 1
FIG 2
FIG 4
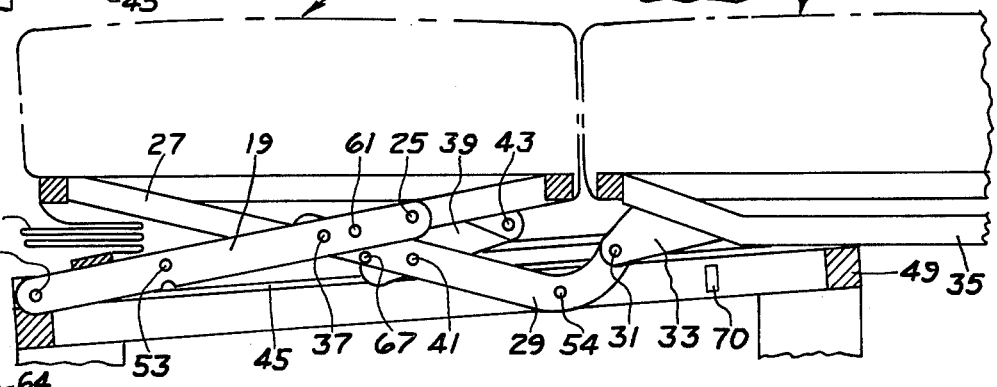
FIG 5
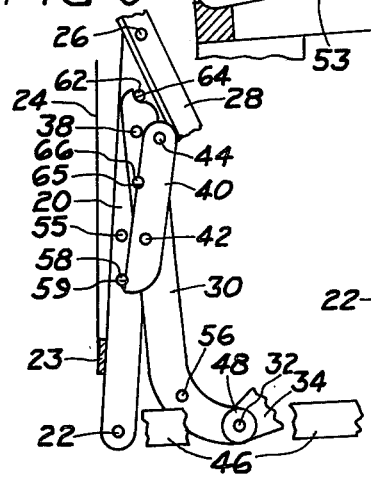
FIG 6
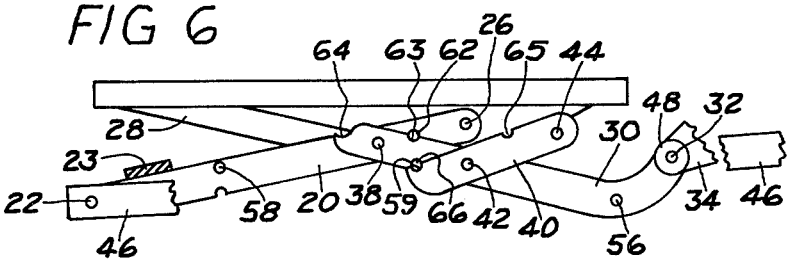

CONVERTIBLE SEAT-BED

This application is a continuation-in-part of my copending application, Ser. No. 402,860, filed Oct. 2, 1973 now U.S. Pat. No. 3,913,152.

This invention relates to a seat-bed assembly and more particularly to an assembly which permits a high degree of efficiency in the utilization of space, as in campers or mobile vehicles and which is rugged in construction and highly reliable while being comparatively simple and economical with respect to manufacture thereof.

BACKGROUND OF THE PRIOR ART

In my aforesaid copending application, I disclose a convertible seat-bed unit in which a back is moved from an inclined position downwardly to a position behind a seat, the seat being moved forwardly, and the back and the seat then having upper surfaces substantially in a common horizontal plane for use as a bed. As also disclosed, a linkage arrangement is provided for effecting the proper conjoint movement of the seat and the back in a manner such that the top edge portion of the back is moved substantially in a vertical path. No forward movement of the supporting frame is required in changing from the seat condition to the bed condition and the arrangement is especially advantageous in camper vehicles or the like in which the supporting frame can be rigidly secured to the frame of the vehicle.

SUMMARY OF THE INVENTION

This invention was evolved with the general object of improving upon the construction as disclosed in my prior application.

One aspect of the invention is in the recognition that in that construction and in other prior art constructions there is a problem with respect to the fact that links and other parts are on the outside, beyond the ends of the back and seat, and one specific object of the invention is to provide a construction in which the operating parts are behind and under the rack rather than on the outside.

Another specific object is to provide an assembly which is relatively simple in construction and operation and economically manufacturable while being rugged and highly reliable.

Another object of the invention is to provide a seat-bed assembly which permits a high degree of efficiency in the use of space especially in camper-type vehicles or the like.

In accordance with an important feature of the invention, a linkage arrangement is provided for supporting and moving a back in a predetermined path in accordance with the movement of a seat between forward and rearward positions thereof. Preferably, the linkage includes arm means pivotal about a horizontal axis below the back and pivotally connected to the back on a second horizontal axis, first link means pivotally connected to the seat on a third horizontal axis and pivotally connected to the arm means on a fourth horizontal axis, and second link means pivotally connected to the first link means on a fifth horizontal axis and pivotally connected to the back on a sixth horizontal axis. The distances between the axes are so predetermined that the top edge portion of the back is moved in a substantially vertical path while the back is moved between the seat and bed positions thereof and are also such that the back is brought down to a position in which its edge portion which is lowermost in the seat position is contiguous to the rearward portion of the seat with the upper surfaces of the back and set being in a horizontal plane.

Additional specific features to the specific forms of the arm means and to the two link means in a manner such that the back is securely supported in both its seat and bed positions. Another important feature relates to the provision of a pair of units in facing relation, each of which may preferably include the aforesaid linkage arrangement of this invention. When the seats of both units are moved forwardly, the forward edges thereof are brought into a position adjacent each other and the upper surfaces of the seats and backs of both units are then in a common horizontal plane to serve as a bed. In camper-type vehicles, a dinette table may be removably disposed between the two units.

This invention contemplates other objects, features and advantages which will become more fully apparent from the following detailed description taken in conjunction with the accompanying drawings.

BRIEF DESCRIPTION OF THE DRAWINGS

FIG. 1 is a perspective view of a seat-bed assembly in accordance with this invention, illustrating two units each in a seating condition;

FIG. 2 is a perspective view similar to FIG. 1, but illustrating the units in a bed condition;

FIG. 3 is a sectional view of one of the units, taken substantially along line III—III of FIG. 2 and illustrating the linkage of the unit at one end thereof;

FIG. 4 is a view similar to FIG. 3, but illustrating the position of the parts in a bed condition of the unit;

FIG. 5 is a view looking in the same direction as in FIG. 3, but showing portions of the linkage at the opposite end of the unit; and FIG. 6 is a view similar to FIG. 5, but illustrating the positions of the parts in the bed condition.

DESCRIPTION OF A PREFERRED EMBODIMENT

Reference numeral 10 generally designates a seat-bed assembly constructed in accordance with the principles of this invention. In the illustrated arrangement, two seat-bed units 11 and 12 are provided in facing relation, secured to a floor 13 which may, for example, be the floor of a camper-type vehicle. The units 11 and 12 include seats 15 and 16 and backs 17 and 18 movable from a seating condition as illustrated in FIG. 1, in which the backs 17 and 18 project upwardly and slightly rearwardly from rearward edge portions of the seats 15 and 16, to a bed condition as illustrated in FIG. 2 in which the forward edges of the seats 15 and 16 are contiguous to each other and in which the upper surfaces of the seats 15 and 16 and backs 17 and 18 in a common horizontal plane, for sleeping thereon. A dinette table may, if desired, be disposed between the units 11 and 12 in the condition of FIG. 1 and removed when the bed condition is desired as shown in FIG. 2. The spaces under the seats 15 and 16 may be enclosed as illustrated, with suitable doors (not shown) being provided for access for storage.

FIG. 3 shows a linkage arrangement at one end of the unit 11 while FIG. 5 is a view showing a corresponding linkage in the same condition at the opposite end of the unit 11, both views being in the same direction. The linkages include swing arms 19 and 20 which are pivotally supported by means of pins 21 and 22 near the rearward corners of frame structure for the unit. A bar 23 is rigidly connected at its opposite ends to the arms 19 and 20 so that they will swing in unison and, if desired, a fabric material 24 may extend from the bar 23 to the upper rearward edge of the back 17. It is noted that cushioning and upholstering material is not shown in FIGS. 3 and 4 but the position thereof is indicated in broken lines.

At the opposite ends, the arms 19 and 20 are pivotally connected by pins 25 and 26 to suitable brackets which are rigidly secured to frame members 27 and 28 of the back 17. A first pair of links 29 and 30 are provided which are pivotally secured by means of pins 31 and 32 to brackets 33 and 34 secured to the seat 15. Bracket 33 is secured to a frame member 35 of the seat 15, shown in FIG. 3, while bracket 34 is secured to a similar frame member at the opposite end of the seat 15. The links 29 and 30 are also pivotally secured by pins 37 and 38 to the arms 19 and 20.

A second pair of links 39 and 40 are provided pivotally connected by pins 41 and 42 to the links 29 and 30 and also pivotally connected by pins 43 and 44 to the brackets which are secured to the frame members 27 and 28.

The pins 31 and 32, connecting the lower ends of the links 29 and 30 with the seat brackets 33 and 34, carry rollers which are movable in track members 45 and 46 secured to the frame structure of the unit 11 on the opposite ends of the unit. The roller carried by the pin 31 is not visible in FIG. 3 but the track 46 is shown broken away in FIG. 5 to show a roller 48 on the pin 32 and it will be understood that a similar roller is provided on the pin 31 for riding in the track 45. The tracks 45 and 46 are preferably inclined as shown and when the seat 15 is moved to its forward position, the elevation of the portions of the tracks engaged by the rollers are such that which the frame member 35 and a corresponding frame member at the opposite end of the seat 15 resting on a frame member 49 of the unit, the upper surface of the seat 15 is substantially in a horizontal plane as illustrated in FIG. 4. On the other hand, when the seat is moved back to the position of FIG. 3, the upper surface thereof is inclined upwardly in parallel relation to the tracks 45 and 46, to provide a more comfortable seat.

The operation of the linkage arrangements will be understood by comparison of FIGS. 3 and 5 with FIGS. 4 and 6. As the seat 15 is moved forwardly, the arms 19 and 20 rotate in a clockwise direction, moving the pins 25 and 26 downwardly and forwardly in an arc about the axis of pin 22. At the same time, the links 29 and 30 rotate in a counter-clockwise direction about the axis of the pins 31 and 32 which axis is moved forwardly. The links 39 and 40 swing in a clockwise direction about the axis of the pins 41 and 42, and through pins 43 and 44 control the movement of the back 17 in a manner such that the upward and rearward edge portion thereof moves in a substantially vertical path. When the seat 15 reaches the forward positon, the upper surface thereof is substantially horizontal and in substantially the same plane as the upper surface of the back 17.

When the seat is moved rearwardly, the reverse action takes place. Preferably, spring means are provided to assist such reverse action and most preferably, coil tension springs are provided between the arms 19 and 20 and the links 29 and 30.

As shown in FIG. 3, a spring 52 is provided between a pin 53 on the arm 19 and a pin 54 on the lever 29. A similar spring may be provided at the opposite end, between a pin 55 on the arm 20 and a pin 56 on the link 30.

Another specific feature is in the provision of means for limiting movements of the arms and links to obtain a stable positioning of the back 17. The arms 19 and 20 carry pins 57 and 58 in positions such as to engage in notches of the links 39 and 40 in the seating condition of the unit, link 40 having a notch 59 as shown in FIG. 6, and the link 39 having a similar notch, not visible in FIGS. 3 and 4. In addition, the arms 19 an 20 carry pins 61 and 62 at positions intermediate the axis of the pins 25 and 26 and the axis of the pins 37 and 38. Pins 61 and 62 engage portions of the links 29 and 30 at both end positions of the linkage. Preferably, as shown in FIG. 6, the link 30 is provided with a notch 63 for receiving the pin 62 in the position shown in FIG. 6 and another notch 64 for receiving the pin 62 in the position shown in FIG. 5.

The link 29 is provided with notches similar to the notches 63 and 64.

As also shown in FIGS. 5 and 6, link 40 is provided with a notch 65 which receives a pin 66 on the link 30 in the seating condition, link 39 being provided with a similar notch and the link 29 is provided with a similar pin, one end of which appears in FIG. 4 and is designated by reference numeral 67. It is noted that in the bed condition, pin 66 engages in the notch 59 of the link 40 and pin 67 of the link 30 engages in the similar notch of the link 39.

As shown in FIG. 3, a lock pin 70 is provided, adapted to extend through an opening in the lower flange portion of a track 45 and through an opening in a flange portion of the frame member 35, such openings being aligned in the seating condition as illustrated in FIG. 3. A similar lock pin is provided at the opposite end for cooperation with the track 46 and the frame member corresponding to frame member 35 and suitable means, not shown, are provided for moving the lock pins downwardly to permit movement to the bed condition. With such locking means, the assembly can be securely locked in the seating condition and it is noted that the stop pin arrangement is such as to insure that the back 17 is securely held. With reference to FIG. 5, it is noted that in the seating condition, the link 40 is held against counter-clockwise movement by engagement of the pin 66 in the notch 65 and that it is also held against clockwise movement by engagement of the pin 58 in the notch 59, the link 39 at the opposite end being similarly held against movement.

The relative dimensions, with respect to the spatial relationship of the pivot axes with respect to each other and to the surfaces of the feet and back are quite important to obtain optimum operation. With respect to the illustrated construction, the axes of pins 21 and 22 may be considered as a first axis, the axis of pins 25 and 26 as a second axis, the axis of pins 31 and 32 as a third axes, the axis of pins 37 and 38 as a fourth axis, the axis of pins 41 and 42 as a fifth axis, and the axis of pins 43 and 44 as a sixth axis. If the distance between the first and fourth axes is taken as unity, the ratios of the other distances with respect thereto are aproximately as follows:

Distance between first and second axes — 1.31.
Distance between third and fourth axes — 1.03.
Distance between fifth and sixth axes — 0.3.

Distance between first and third axes, in the seat condition — 0.4; in the bed condition — 2.0.

Distance between second and sixth axes — 0.31.

Distance of rearward offset of fifth axis from plane through third and fourth axes — 0.3.

Distance from plane through second and sixth axes to the front or upper surface of back — 0.625.

Distance from the sixth axis to plane of lower side of back — 0.2.

Distance from third axis to plane of top surface of seat — 0.75.

Distance from top to bottom of back — 1.93.

Such ratios may be varied to some extent but should be approximately as listed, to obtain optimum operation.

It will be understood that modifications and variations may be effected without departing from the spirit and scope of the novel concepts of this invention.

I claim as my invention:

1. In a convertible seat-bed assembly, a unit including a generally rectangular back having generally parallel opposite top and bottom edge portions, back support means supporting said back for movement between an inclined seating position in which said top edge portion thereof is in a first position spaced upwardly and rearwardly with respect to said bottom edge portion thereof and a bed position in which said top edge portion thereof is in a second positon spaced rearwardly from and in horizontal alignment with said bottom edge portion thereof, a generally rectangular seat having generally parallel forward and rearward edge portions, seat support means supporting said seat for movement thereof is disposed below and behind said bottom edge portion of said back when said back is in said first position and a forward bed position in which said rearward edge portion thereof is contiguous to said bottom edge portion of said back with the upper surface of said back and seat then being in a common horizontal plane, said back support means comprising arm means pivotal about a first horizontal axis below said back and pivotally connected to said back on a second horizontal axis, first link means pivotally connected to said seat on a third horizontal axis and pivotally connected to said arm means on a fourth horizontal axis, and second link means pivotally connected to said first link means on the fifth horizontal axis and pivotally connected to said back on a sixth horizontal axis, said second horizontal axis being spaced a first predetermined distance from said first horizontal axis and being on the rearward side of said back and spaced a second predetermined distance from said bottom edge portion of said back, said fourth horizontal axis being spaced a third predetermined distance from said second horizontal axis and said sixth horizontal axis being spaced a fourth predetermined distance from said fifth horizontal axis, the relationship between said first, second, third and fourth predetermined distances being such that said top edge portion of said back is moved in a substantially vertical path between said first and second positions thereof when said seat is moved forwardly and rearwardly between said rearward seat and forward bed positions thereof.

2. In an assembly as defined in claim 1, said fourth axis being below a horizontal plane through said second axis in said seating position of said back and being above a plane through said first and third axes in said bed position of said back.

3. In an assembly as defined in claim 1, said sixth axis in said seating position of said back being spaced a substantial distance above a horizontal plane through said fifth axis and being spaced forwardly a smaller distance from a vertical plane through said fifth axis.

4. In an assembly as defined in claim 3, said sixth axis in said bed position of said back being spaced above a horizontal plane through said fifth axis and being also spaced forwardly from a vertical plane through said fifth axis.

5. In an assembly as defined in claim 1, said first, second and fourth axes being substantially in a common plane.

6. In an asembly as defined in claim 1, said second and sixth axes being in a common plane generally parallel to the front surface of said back.

7. In an assembly as defined in claim 1, spring means acting on said arm and link means to exert a force urging said back away from said bed position and toward said seating position.

8. In an assembly as defined in claim 7, said spring means comprising tension spring means connected between said arm means and said first link means.

9. In an assembly as defined in claim 1, first stop means for limiting rearward movement of said back with respect to said seating position thereof, and second stop means for limiting downward movement of said back with respect to said bed position thereof.

10. In an assembly as defined in claim 9, said first and second stop means including interengaging means on said first link means and said arm means.

11. In an assembly as defined in claim 10, said first and second means further including interengaging means on said first and second link means.

12. In an assembly as defined in claim 11, said first and second stop means further including interengaging means on said second link means and said arm means.

* * * * *